US007311470B2

(12) United States Patent
Weyant et al.

(10) Patent No.: US 7,311,470 B2
(45) Date of Patent: Dec. 25, 2007

(54) WALE AND RETAINING WALL SYSTEM

(75) Inventors: Shane E. Weyant, Bedford, PA (US); Dustin L. Troutman, Hopewell, PA (US)

(73) Assignee: Creative Pultrusions, Inc., Alum Bank, PA (US)

( * ) Notice: Subject to any disclaimer, the term of this patent is extended or adjusted under 35 U.S.C. 154(b) by 0 days.

(21) Appl. No.: 10/619,131

(22) Filed: Jul. 14, 2003

(65) Prior Publication Data

US 2004/0013476 A1 Jan. 22, 2004

Related U.S. Application Data

(62) Division of application No. 10/199,852, filed on Jul. 19, 2002, now Pat. No. 6,893,191.

(51) Int. Cl.
*E04C 5/08* (2006.01)
*E02D 29/02* (2006.01)

(52) U.S. Cl. ..... 405/284; 405/262; 405/274; 256/1; 52/169.1; 52/223.13

(58) Field of Classification Search ..... 405/262, 405/274–281, 284, 285; 52/655.1
See application file for complete search history.

(56) References Cited

U.S. PATENT DOCUMENTS

| | | | | |
|---|---|---|---|---|
| 2,110,253 | A * | 3/1938 | Zur Nedden | 405/259.1 |
| 3,385,557 | A * | 5/1968 | Rambelle | 249/210 |
| 3,739,588 | A | 6/1973 | Schroter et al. | |
| 4,016,696 | A * | 4/1977 | Mess et al. | 52/514 |
| 4,124,983 | A | 11/1978 | Weatherby | 405/259.5 |
| 4,260,296 | A | 4/1981 | Hilfiker | 405/284 |
| 4,350,318 | A * | 9/1982 | Gallis | 249/40 |
| 4,570,402 | A * | 2/1986 | Johnson | 52/241 |
| 4,674,921 | A | 6/1987 | Berger | 405/262 |
| 4,690,588 | A | 9/1987 | Berger | 405/262 |

(Continued)

FOREIGN PATENT DOCUMENTS

| | | |
|---|---|---|
| DE | 31 45 153 A1 | 6/1983 |
| GB | 2 278 902 A | 12/1994 |
| GB | 2 356 884 A | 6/2001 |

OTHER PUBLICATIONS

Enduro Systems, Inc. Aug. 2001□□http://web.archive.org/web/2001081030017/http://www.endurocomposites.com/.*

(Continued)

*Primary Examiner*—Tara L. Mayo

(57) ABSTRACT

A wale for use in bracing a retaining wall. The wale is comprise of a back wall, a front wall having a channel formed therein, and a plurality connecting walls connecting the back and front walls to form at least one chamber between the back and front walls. In one embodiment, the wale is of unitary construction and the plurality of connecting walls includes top and bottom walls which form a single chamber between the back and front walls. In an alternative embodiment, the wale is of a unitary construction and the plurality of connecting walls includes atop, upper reinforcing, lower reinforcing, and bottom walls, which form a plurality of chambers between the back and front walls. The wale may by made of a pultruded composite material such as a fiberglass reinforced plastic (FRP) resin impregnated composite. A seawall system using such a waler is also described.

7 Claims, 8 Drawing Sheets

U.S. PATENT DOCUMENTS

| | | | | | |
|---|---|---|---|---|---|
| 4,728,225 | A | | 3/1988 | Brandl et al. | 405/262 |
| 4,917,543 | A | | 4/1990 | Cole et al. | 405/262 |
| 5,145,287 | A | | 9/1992 | Hooper et al. | 405/262 |
| 5,154,541 | A | | 10/1992 | Boren et al. | 405/272 |
| 5,244,316 | A | | 9/1993 | Wright et al. | 405/285 |
| 5,285,612 | A | | 2/1994 | Johnson | |
| 5,285,613 | A | | 2/1994 | Goldsworthy et al. | 52/648.1 |
| 5,368,414 | A | | 11/1994 | Miller | 405/262 |
| 5,435,669 | A | * | 7/1995 | Weber | 405/284 |
| 5,580,191 | A | | 12/1996 | Egan | 405/262 |
| 5,584,610 | A | | 12/1996 | Simpson et al. | 405/281 |
| 5,683,609 | A | * | 11/1997 | Schworer | 249/18 |
| 5,765,970 | A | * | 6/1998 | Fox | 405/284 |
| 5,772,185 | A | | 6/1998 | Pulsipher | 256/59 |
| 5,901,523 | A | * | 5/1999 | Tasi | 52/653.2 |
| 6,024,516 | A | | 2/2000 | Taylor et al. | 405/262 |
| 6,033,155 | A | | 3/2000 | Irvine et al. | 405/281 |
| 6,053,666 | A | | 4/2000 | Irvine et al. | 405/279 |
| 6,092,473 | A | * | 7/2000 | Altenburg et al. | 105/404 |
| 6,135,675 | A | | 10/2000 | Moreau | 405/284 |
| 6,168,351 | B1 | * | 1/2001 | Rainey | 405/262 |
| 6,264,403 | B1 | | 7/2001 | Hall et al. | 405/252.1 |
| 6,299,386 | B1 | | 10/2001 | Byrne et al. | 405/273 |

OTHER PUBLICATIONS

Introducing Composite Z, 29 pages of website, Composite Z.com—Wales, Tiebacks, & Caps, http://209.41.112.194.

C-Loc Engineered Vinyl Sheet Piling, 13 pages of website, http://www.c-loc.com.

Foster Piling, A division of L.B. Foster Company and Chaparral Steel, 14 Pages of website, http://www.sheetpiling.com.

Materials International, 15 pages of website, http//www.materialsintl.com.

The Final Solution to Shoreline Erosion, manual, Aluminum Retaining Wall Systems, Ravens Marine, Inc.

Strongwell Website Aug. 2000, http://web.archive.org/web/20000815094253/www.strongwell.com/PULT/Pultrusion.htm.

Enduro Systems, Inc. Aug. 2001, http://web.archive.org/web/20010810130017/http://www.endurocomposites.com/.

* cited by examiner

WALE AND RETAINING WALL SYSTEM

CROSS-REFERENCE TO RELATED APPLICATIONS

The present invention is a divisional of U.S. application Ser. No. 10/199,852 entitled "Wale and Retaining Wall System" filed 19 Jul. 2002 now U.S. Pat. No. 6,893,191 and assigned to the same assignee as the present invention.

FIELD OF THE INVENTION

The present invention relates generally to pultruded-composite components and more particularly to the application of pultruded-composite components for a sheet pile system, such as for a retaining wall.

BACKGROUND

The use of sheet pile systems for retaining walls is know in the art. Examples of such systems include U.S. Pat. No. 6,135,675 to Moreau, U.S. Pat. No. 5,145,287 to Hooper et al., and U.S. Pat. No. 4,690,588 to Berger. Wood, steel, aluminum, and vinyl have traditionally been used to construct retaining walls. Each of these materials, however, has certain limitations. For example, wood is subject to rotting and insect infestation, and thus, has a relatively short life span as compared to the other materials. Steel is subject to corrosion, and because of its weight, requires additional equipment and manpower to install, thus increasing its overall cost. Aluminum, although lighter than steel and easier to install, is also subject to corrosion in certain applications. Vinyl, although lightweight and resistant to corrosion, lacks the strength of the other materials, and thus, is usually required to be used in conjunction with one or more of the other materials.

Composite components have been introduced to replace wood, steel, aluminum, and vinyl sheet pile components. Composite materials may be manufactured using a pultrusion process. In one type of pultrusion process, glass fibers are pulled through a resin bath where the glass fibers become saturated with a liquid thermosetting resin. Next, the coated fibers are formed to the proper shape using a forming guide or die. Finally, the reinforced material may be drawn through a heated curing die. Composite sheet pile components are stronger, easier to install, and longer lasting than their wood, steel, aluminum, and vinyl counterparts.

In a typical sheet pile retaining wall installation, pilings are driven into the ground using a vibratory hammer, vibratory plate compactor, jackhammer with a sheet shoe, or a drop impact hammer, among others. One or more pilings may be driven into the ground at the same time. Adjacent pilings may be interconnected to form a continuous wall. For example, a piling may have a "male" connector on one end and a "female" connector on the other end. The male connector of a first piling is mated with the female connector of a second piling, and the male connector of the second piling is mated with the female connector of a third piling, and so on, to form the retaining wall. One or more rows of horizontal supports, known as wales or walers, may be placed across the front or back face of the wall to lend additional support. Also, a cap and cap channel may be placed on the top of the wall.

The cap with a cap channel and wales may be connected to a tieback system, which secures the retaining wall. A tieback system normally includes a series of anchor members (or deadmans) and tieback rods. In a seawall application, for example, the tieback system has an anchor located on the land side of the seawall. One end of a tieback rod is attached to the anchor. The other end of the tieback rod passes through the pilings and is secured with a fastener on the sea side of the seawall. In most seawall applications, the tieback rod also passes through the cap and cap channel or wale. Thus, the cap, cap channel, and wale aid in distributing the retaining force exerted by the tieback system over the face of the seawall.

Prior art retaining wall typically use metallic (for example, galvanized, stainless steel, and resin treated steel, etc.) tieback rods. The metallic tieback rods are treated to resist corrosion, however, the metallic tieback rods inevitably corrode over time. The corrosion of the metallic tieback rod may also adversely affect the anchors and retaining wall to which the tieback rod is attached.

Thus, there is the need for a composite tieback rod that better resists the effects of corrosion, that will not adversely affect the anchors and retaining wall to which it is attached, and may be used in a tieback system having composite components.

Furthermore, prior art retaining walls typically use wooden wales. In addition to rotting and insect infestation mentioned above, the use of wooden wales present other problems. For example, the tieback rod and its fastener may protrude from the wale. The exposed end may damage anything coming into contact with the wale. For example, boats pulling up next to a seawall may be scratched, gouged, or even punctured by the tieback rod end protruding from the wale. To overcome this problem, countersink holes may be drilled into the wooden wale such that the tieback rod end and the fastener do not protrude past the face of the wale. However, drilling countersink holes increases the labor necessary to install the wale.

Thus, there is a need for a composite wale that resists rotting, insect infestation, and corrosion (among others), and that is formed with a recess that prevents a tieback rod end and its fastener from protruding beyond the face of the wale. Furthermore, a need exits for a retaining wall system that includes sufficient structural capabilities, which resists rotting, insect infestation, corrosion, and other detrimental effects, and which is lightweight and easy to install.

SUMMARY

The present invention relates to a wale for use in bracing a retaining wall. The wale is comprised of a back wall, a front wall having a channel formed therein, and a plurality of connecting walls connecting the back and front walls to form at least one chamber therebetween. In one embodiment, the wale is of unitary construction and the plurality of connecting walls include top and bottom walls which form a single chamber between the back and front walls. In an alternative embodiment, the wale is of a unitary construction and the plurality of connecting walls include a top, upper reinforcing, lower reinforcing, and bottom walls, which form a plurality of chambers between the back and front walls. The wale may be made from a pultruded composite material, such as a fiberglass reinforced plastic (FRP) resin impregnated composite.

The present invention also relates to a retaining wall system comprised of a plurality of anchors, a plurality of tieback rods, a plurality of tieback fasteners, a plurality of pultruded, composite, inter-locking sheet pilings, and a cap member comprised of the same material as, and operable to cover the top of, the sheet pilings. The retaining wall system also includes a cap connector operable to join at least two adjacent cap members. The cap, alone or in combination with a cap channel, and/or a wale member are operable to distribute a force exerted by the anchors, tieback rods, and tieback fasteners along the plurality of sheet pilings. The wale member is constructed of the same material as the sheet pilings, and adjacent wale members are joined by a wale splice.

The retaining wall system's tieback rods may have a first end and a second end, the first end being secured to one of the anchors and a second end being secured by a tieback fastener on the opposite side of the retaining wall relative to the anchor after passing through the sheet pilings. Alternatively, the second end of the tieback rod (after passing through the sheet piling) may further pass through a cap or a wale before being secured by the tieback fastener on the opposite side of the retaining wall relative to the anchor. The tieback rod is comprised of a composite pultruded material and may be of unitary construction.

BRIEF DESCRIPTION OF THE DRAWINGS

To enable the present invention to be easily understood and readily practiced, the present invention will now be described for purposes of illustration and not limitation, in connection with the following figures wherein.

DETAILED DESCRIPTION

Figure 1:
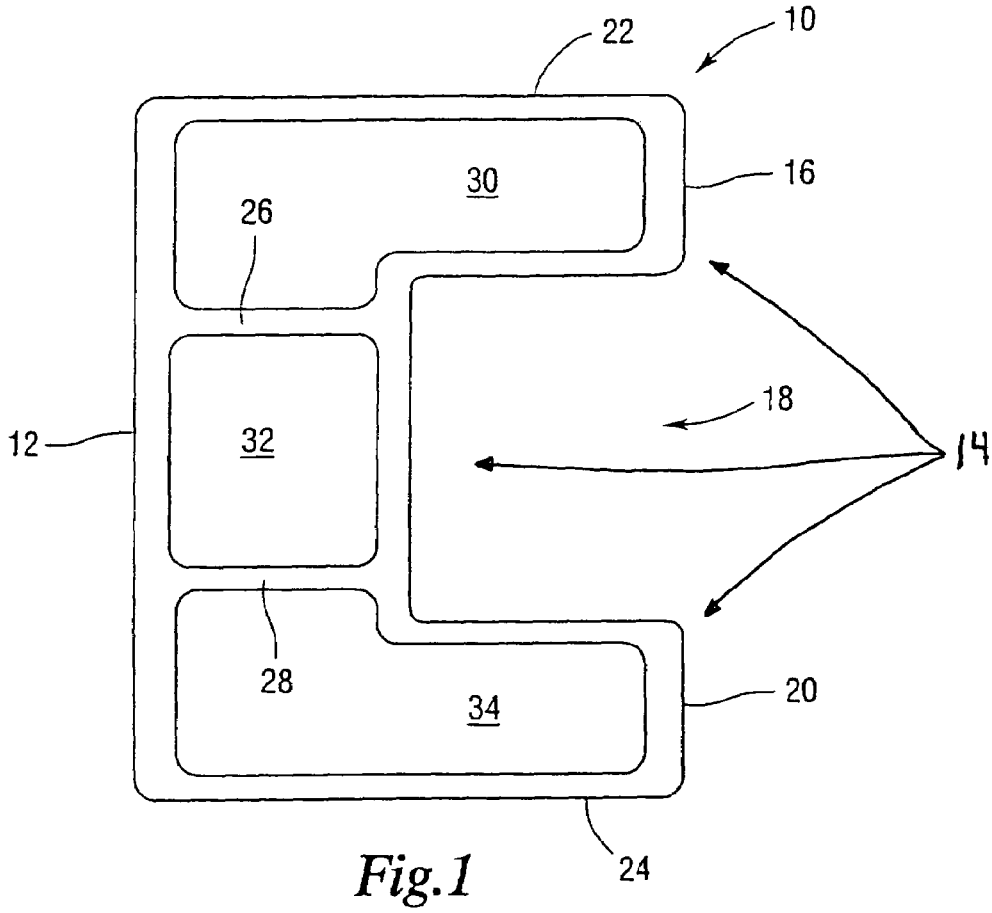
FIG. 1 illustrates the cross-section of a retaining wall wale according to an embodiment of the present invention.

FIG. 1 illustrates a cross-section of a retaining wall wale 10 according to an embodiment of the present invention. The wale 10 may be used to provide addition bracing to a retaining wall and to distribute, across the face or back of a retaining wall, the forces exerted by a tieback system. Wale 10 is comprised of composite materials (for example, a fiber reinforced plastic (FRP) resin impregnated composite, etc.), is of unitary construction, and is formed using a pultrusion process.

It should be noted, that other composite materials, non-unitary construction methods, and other manufacturing techniques may be used while remaining within the scope of the present invention. For example, thermoset resin systems (such as isopolyester, vinylester, epoxy, polyurethane, and phenolic, among others) may be used with various reinforcement materials (such as e-glass, s-glass, a-glass, carbon, graphite, and Aramid, among others) while remaining within the scope of the present invention. Additionally, thermoplastic systems may also be used while remaining within the scope of the present invention.

In the current embodiment, wale 10 is substantially C-shaped and is comprised of a back wall 12 which is connected to a front wall 14 by a plurality of connecting walls: a top wall 22, a bottom wall 24, an upper reinforcing wall 26, and a lower reinforcing wall 28. The front wall 14 is comprised of a top portion 16, a C-shaped channel portion 18, and a bottom portion 20. The channel portion 18 is of a sufficient depth such that when secured to a retaining wall by a tieback rod and fastener, the tieback rod end and fastener will not protrude from the channel portion 18.

The back 12, front 14, and connecting 22, 24, 26, 28 walls may form one or more chambers 30, 32, 34 within the wale 10. In the current embodiment, three chambers 30, 32, 34 are shown. The upper chamber 30 is defined by the back wall 12, top wall 22, top portion 16, channel portion 18, and upper reinforcing wall 26. The middle chamber 32 is defined by the back wall 12, upper reinforcing wall 26, channel portion 18, and lower reinforcing wall 28. The lower chamber is defined by the back wall 12, bottom wall 24, bottom portion 20, channel portion 18 and lower reinforcing wall 28. It should be noted that the number, shape, and manner of defining the chambers may be varied while remaining within the scope of the present invention. As an example, reinforcing walls may connect the channel portion 18 to the top 22 and bottom 24 walls instead of to the back wall 12.

Figure 1A:
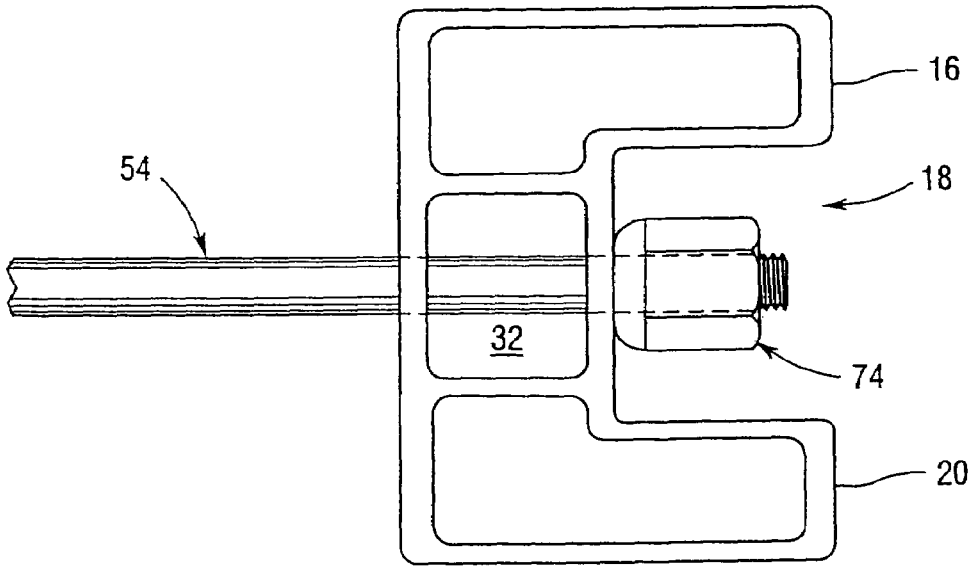
FIG. 1A illustrates a tieback rod and tieback fastener within the channel portion of the wale shown in FIG. 1 according to an embodiment of the present invention.

FIG. 1A illustrates a tieback rod 54 and tieback fastener 74 within the channel portion 18 of the wale 10 shown in FIG. 1 according to an embodiment of the present invention. One end of the tieback rod 54 is attached to an anchor (not shown in FIG. 1A) while the other end passes through the sheet piling (not shown in FIG. 1A) and the wale 10. In the current embodiment, the end of the tieback rod 54 passes through the middle chamber 32 and into the channel portion 18 of the wale 10. The end of tieback rod 54 is secured by a tieback fastener 74. The end of the tieback rod 54 and the fastener 74 are contained within the channel portion 18 and do not protrude out of the channel portion 18 and beyond the face of the top 16 and bottom 20 portions of the front wall 14. In one embodiment of the present invention, both the tieback rod 54 and the fastener 74 are constructed of FRP. In another embodiment, a metallic tieback rod is encased in FRP.

Figure 2:
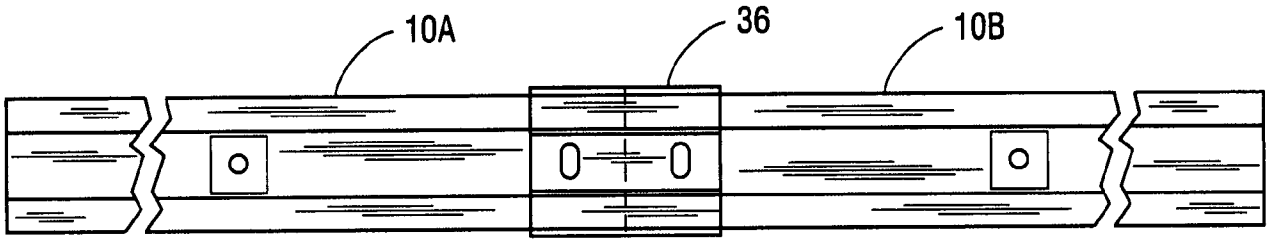
FIG. 2 illustrates a wale splice used to connect two wales (as illustrated in FIG. 1) according to an embodiment of the present invention.

FIG. 2 illustrates a wale splice 36 used to connect two wales (as illustrated in FIG. 1) 10A, 10B according to an embodiment of the present invention. The ends of two wales 10A, 10B abut each other and are held in place by the wale splice 36.

Figure 3B:
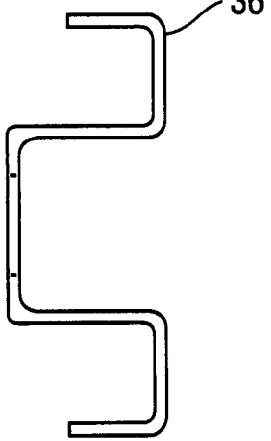
FIG. 3B is a cross-sectional view of the wale splice of FIG. 2 according to an embodiment of the present invention.
Figure 3A:
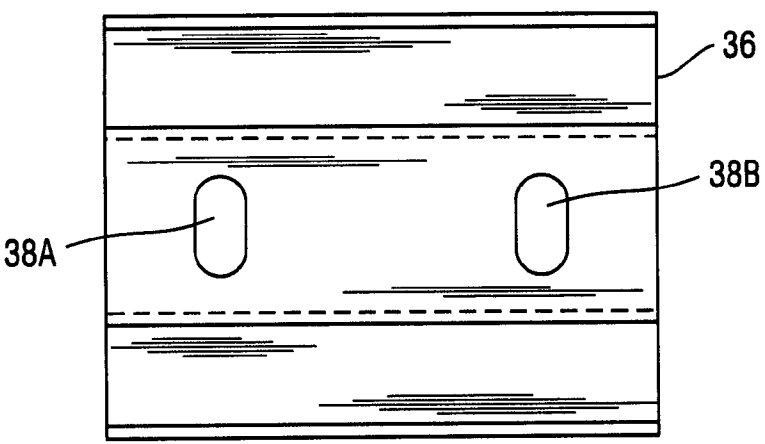
FIG. 3A is a view of the wale splice of FIG. 2 according to an embodiment of the present invention.

FIGS. 3A and 3B are a detailed front and cross-sectional view, respectively, of the wale splice 36 as shown in FIG. 2. In the current embodiment, and as best illustrated in FIG. 3B, wale splice 36 is formed to fit within the channel portion 18, cover the top 16 and bottom 20 portions of the front wall 14, and wrap around to cover a portion of the top 22 and bottom 24 walls of wale 10. As best illustrated in FIG. 3A, wale splice 36 includes a plurality of splice holes 38A, 38B which allow a bolt (or other fastener) from wales 10A, 10B to be inserted though wale splice 36.

In the current embodiment, wale splice 36 is placed over the joint where wale 10A abuts wale 10B. Splice hole 38A is aligned with a wale hole in wale 10A. Splice hole 38B is aligned with a wale hole in wale 10B. Bolts (not shown in FIG. 2) are then passed through the wale holes and splice holes 38A, 38B and secured with a nut (not shown in FIG. 2). The bolt end and fastener do not extend out of the channel of the wale splice 36. The wale splice 36 secures wale 10A to wale 10B.

In the current embodiment, holes 38A, 38B are elliptical slots disposed vertically to permit adjustment of the wale splice 36. It should be noted that other opening shapes (such as horizontally disposed elliptical slots and round holes, among others) may be used while remaining within the scope of the present invention. It should also be noted a tieback rod end, may be used to secure the wale splice 36 to the wale 10A, 10B.

Figure 4:
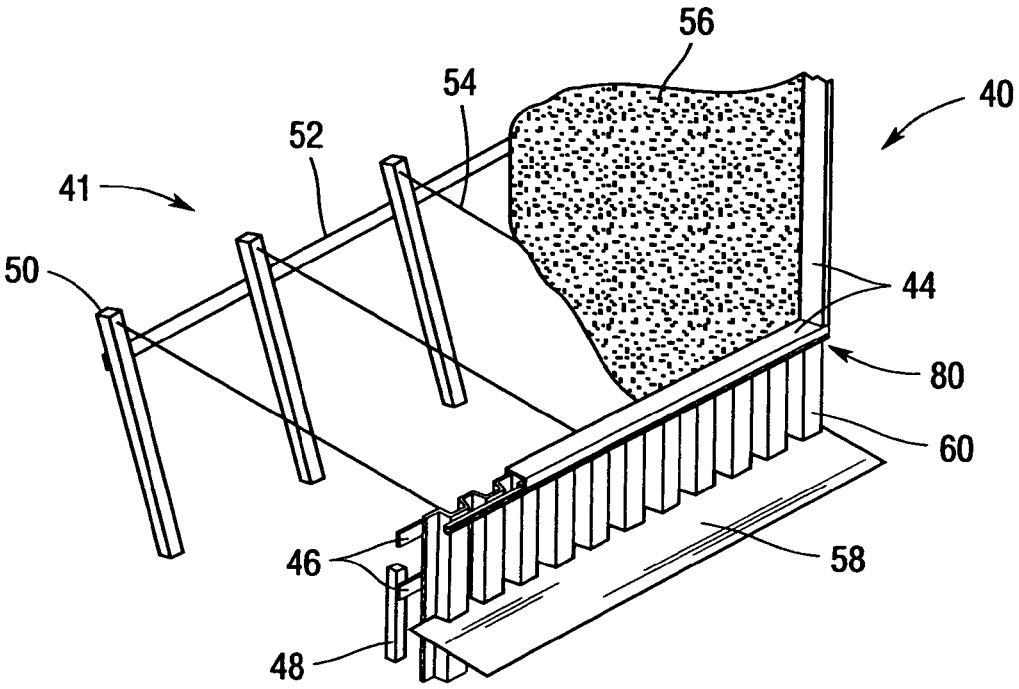
FIG. 4 illustrates a retaining wall system according to an embodiment of the present invention.

FIG. 4 illustrates a retaining wall system 40 according to an embodiment of the present invention. Retaining wall system 40 includes a tieback system 41, sheet pilings 60, caps 44, a cap spacer tube 76 (not shown in FIG. 4), cap connector (not shown in FIG. 4) sheet piling connectors 66, 68 (not shown in FIG. 4), template supports 48, and inside wales 46. The tieback system 41 may include anchors (or deadmans) 50, connecting boards 52, tieback rods 54, caps 44, cap channels 80, wales (not shown in FIG. 4), wale splices (not shown in FIG. 4), and fasteners 74 (not shown in FIG. 4), among others. The tieback system 41 may be comprised solely of composite materials, or may be comprised of both composite and non-composite materials.

In one embodiment, the retaining wall system 40 is constructed according to the following layout. One or more anchors 50 are placed into the ground behind where the retaining wall is to be installed. The anchors 50 are interconnected using one or more connecting boards 52. One or more template supports 48 are driven into the ground (in front of the anchors 50) in the approximate location of where the sheet pilings 60 are to be located. The template supports 48 act as an installation guide for the sheet pilings 60. The template supports 48 may be connected to each other by one or more inside wales 46. The sheet pilings 60 are driven into the ground in front of and next to the template supports 48. A portion of each sheet piling 60 is left exposed above the mud line 58. The sheet pilings 60 are inter-connected with each other to form the retaining wall. Once the sheet pilings 60 are installed, the template supports 48 and inside wales 46 are removed. Alternatively, the template supports 48 and inside wales may be abandoned in place, or may be secured to the retaining wall.

The tieback system 41 is connected to the retaining wall. For example, a first end of a tieback rod 54 is attached to an anchor 50. One or more caps 44 are placed on the top of the sheet pilings 60. A second end of the tieback rod 54 passes through the retaining wall sheet pilings 60 and the cap 44. A cap channel 80 is then placed horizontally across the face of the cap 44; the second end of the tieback rod 54 passing through the cap channel 80. The second end of the tieback rod 54 is secured by a tieback fastener 74 (such as a bolt, washer and bolt combination, etc.) positioned within cap channel 80. A backfill material 56 is then placed between the anchors 50 and the sheet pilings 60. The backfill 56 is used to cover and provide additional strength to the tieback system 41.

Figure 5:
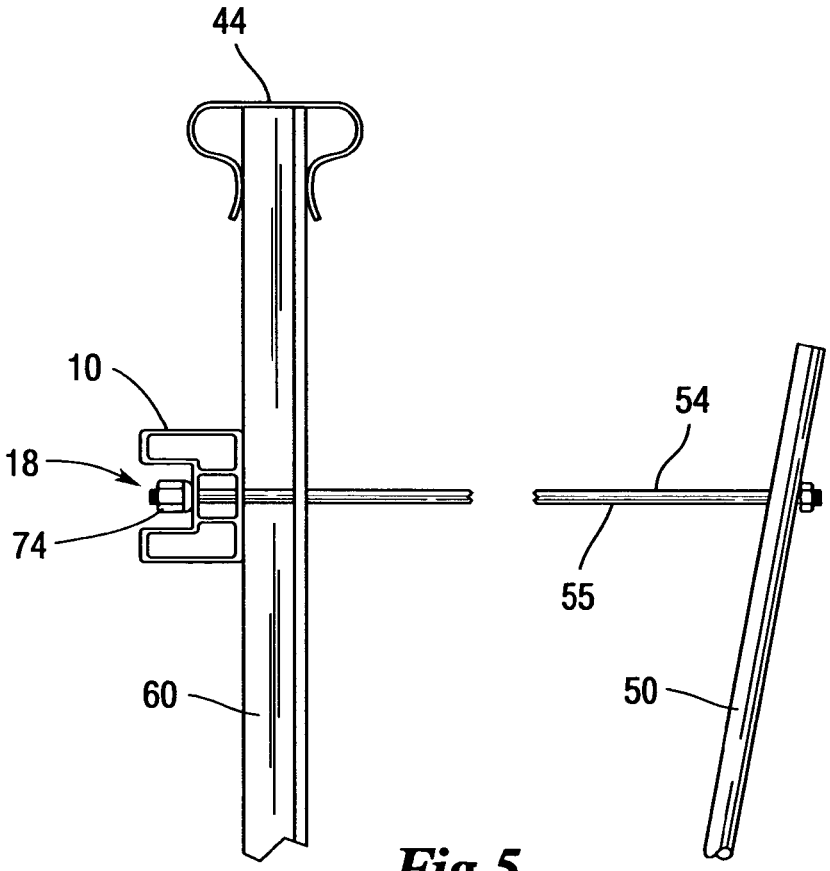
FIG. 5 is a cross-sectional view of a tieback system according to an alternative embodiment of the present invention.

FIG. 5 is a cross-sectional view of a tieback system 41 according to an alternative embodiment of the present invention. Unlike FIG. 4 in which the cap 44 and cap channel 80 act as a component of the tieback system 41, FIG. 5 illustrates the tieback rod 54 securing a wale 10 against the face of the sheet piling 60. As illustrated in FIG. 5, cap 44 does not functioning as part of the tieback system 41. The tieback rod 54 may be comprised of a rod shaft 55 having a first and a second end. In the current embodiment, the tieback rod 54 is comprised of a pultruded composite material and is of unitary construction. Alternatively, the tieback rod 54 may be of non-unitary construction (i.e., only a portion of the tieback rod 54 may be comprised of a pultruded composite material). For example, the rod shaft 55 may be comprised of a metallic material (such as, galvanized steel and stainless steel, among others) which is encased within a pultruded composite material. In the current embodiment, the tieback rod 54 is substantially cylindrical, although other shapes may be used while remaining within the scope of the present invention. The diameter and length (as well as the shape) of the tieback rod 54 may tailored to the specific application.

In the current embodiment, one end of the tieback rod 54 is secured to an anchor 50, while the second end passes through the sheet piling 60 and the center chamber 32 of the wale 10, and is secured with a tieback fastener 74. In the current embodiment, a washer and nut combination is used to secure the second end of the tieback rod 54. The second end of the tieback rod 54 and the tieback fastener 74 do not protrude out of the channel 18 of the wale 10. It should be noted that a tieback system 41 which utilizes both a wale 10 and a cap/cap channel combination may be is used while remaining within the scope of the present invention.

Figure 6:
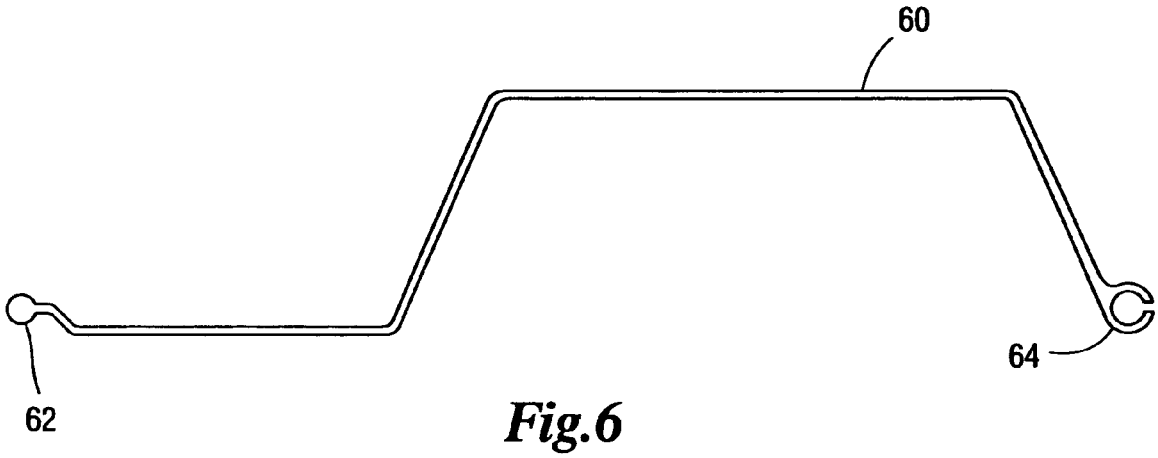
FIG. 6 illustrates the cross-section of a sheet piling according to an embodiment of the present invention.

FIG. 6 is a cross-sectional view of a sheet piling 60 according to one embodiment of the present invention. Sheet piling 60 is typically shaped in an appropriate manner to add strength and has a male connector 62 at one end and a female connector 64 at an opposite end. In the current embodiment, the male connector 62 of a first sheet piling 60 interconnects with female connector 64 of a second sheet piling 60. Likewise, the male connector 62 of the second sheet piling 60 interconnects with a female connector 64 of a third sheet piling 60, and so on, until the proper length retaining wall is formed. It should be noted that the shape of the sheet piling 60 and the type or shape of the male and female connectors 62, 64 may be varied while remaining with the scope of the present invention.

Figure 7:
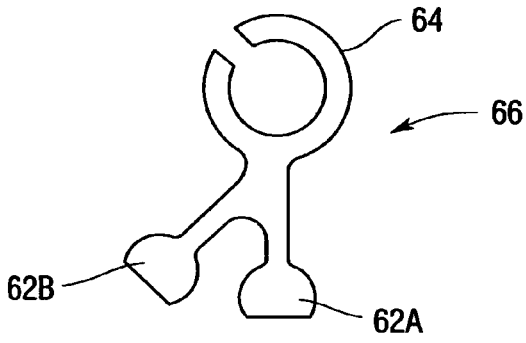
FIG. 7 illustrates a cross-section of a sheet piling connector according to an embodiment of the present invention.
Figure 8:
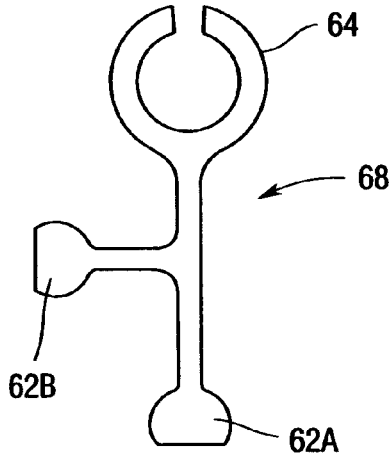
FIG. 8 illustrates a cross-section of a sheet piling connector according to an alternative embodiment of the present invention.

FIGS. 7 and 8 are cross-sectional views of two different types of sheet piling connectors 66, 68, respectively, according to an embodiment of the present invention. Sheet piling connectors 66, 68 allow two or more sheet pilings 60 to be attached to one another at various angles. Sheet piling connector 66, for example, has one female connector 64 and two male connectors 62A, 62B. Male connector 62A forms a 180° angle with the female connector 64, whereas male connector 62B forms a 45° angle with the male connector 62A. Sheet piling connector 66 is referred to as a 180°/45° connector. Likewise, sheet piling connector 68 has one female connector 64 and two male connectors 62A, 62B. Male connector 62A forms a 180° angle with the female connector 64, however, male connector 62B forms a 90° angle with the male connector 62A. Sheet piling connector 68 is referred to as a 180°/90° connector. It should be noted that additional female and male connectors may be added to the sheet piling connector 66, 68 and their relative angles may be varied while remaining within the scope of the present invention.

Figure 9:
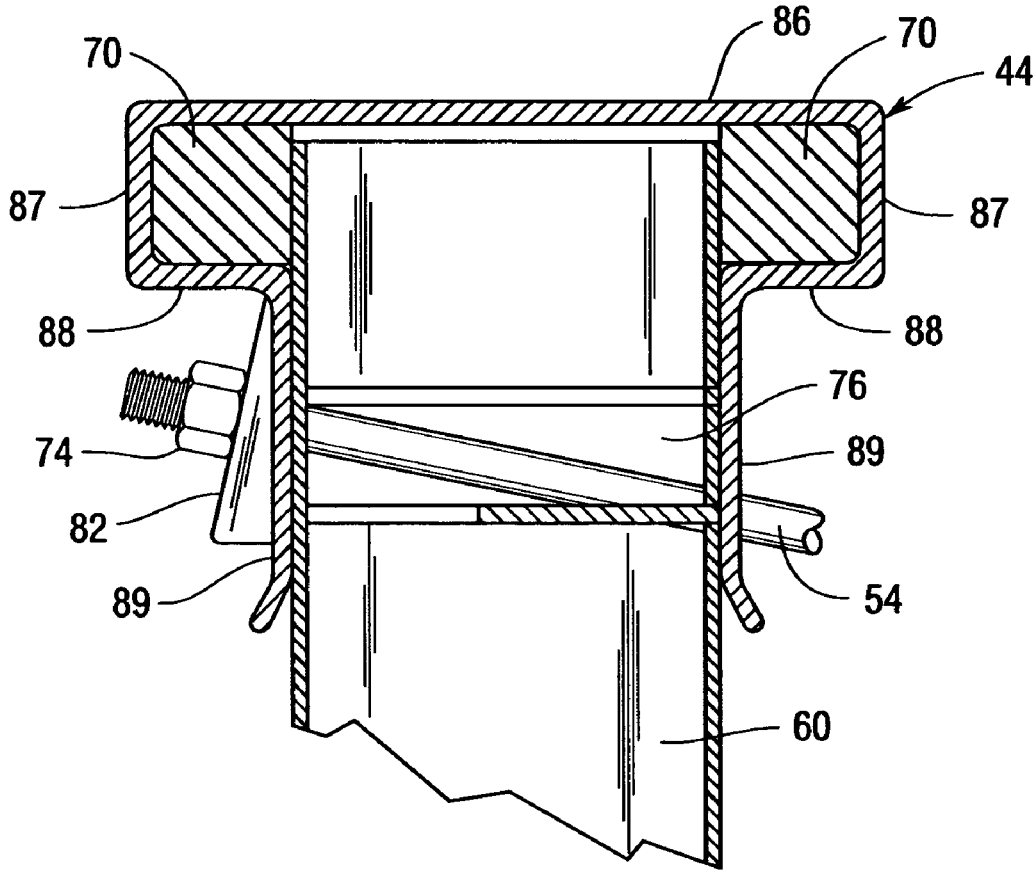
FIG. 9 is a cross-sectional view of a cap for the retaining wall system of FIG. 4 according to an embodiment of the present invention.

FIG. 9 is a cross-sectional view of a cap 44 for the retaining wall system 40 of FIG. 4 according to an embodiment of the present invention. Cap 44 covers the top of sheet piling 60. As shown in FIG. 9, tieback rod 54 enters through the land side of cap 44, passes through a cap spacer tube 76 and the sheet piling 60, and exits the sea side of cap 44. The tieback rod 54 is then secured with a tieback fastener 74. For example, in the current embodiment, tieback rod 54 includes a threaded end to which a fastener 74 (such as a nut) is attached. Additionally, a shim 82 may be inserted between the sea side of the cap 44 and the tieback fastener 74 to better distribute the forces exerted by the tieback system.

Figure 14:
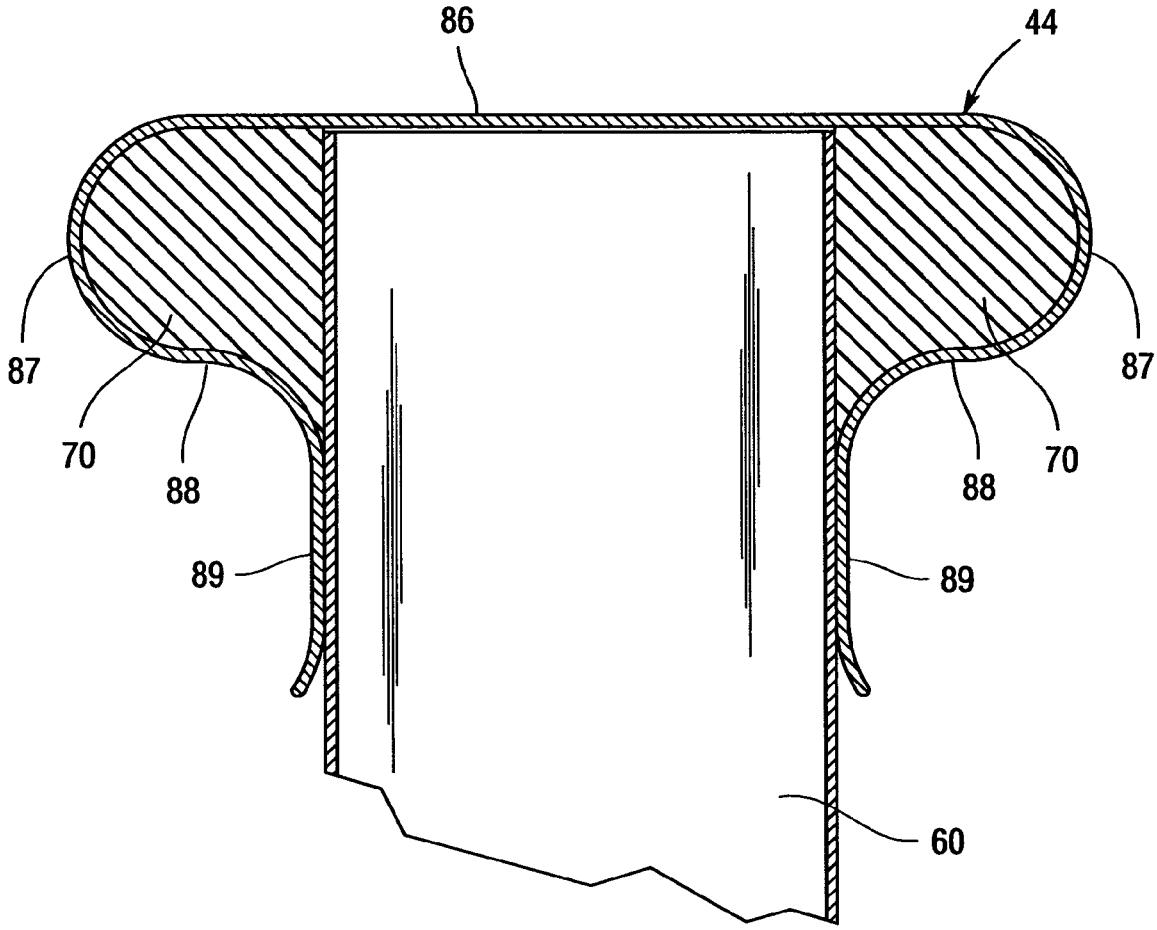
FIG. 14 is a cross-sectional view of a cap for the retaining wall system of FIG. 4 according to an embodiment of the present invention.

In the current embodiment (as best illustrated in FIG. 9), cap 44 has multiple walls which form a T-shaped channel. A top cap wall 86 connects two upper side walls 87, each of which are connected to a lower side wall 89 via an offset wall 88. Cap spacer tube 76 separates the two lower side walls 89 and prevents the T-shaped cap from collapsing under the forces exerted by the tieback system 41. It should be noted, however, that the shape of the cap may be altered while remaining within the scope of the present invention. For example, FIG. 14 illustrates a T-shaped cap 44 in which the upper side walls 87 and offset walls 88 are rounded.

Figure 10:
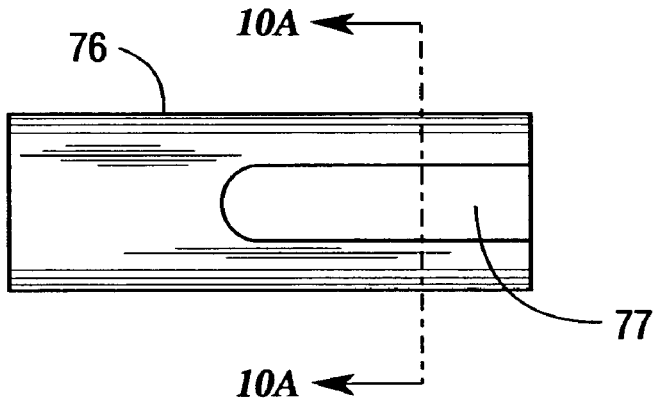
FIG. 10 is a detailed bottom view of the cap spacer tube for cap shown in FIG. 9 according to an embodiment of the present invention.
Figure 10A:
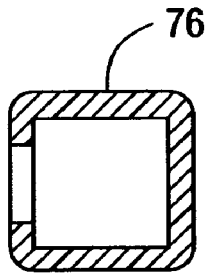
FIG. 10A is a cross-sectional view of the cap spacer tube of FIG. 10 according to an embodiment of the present invention.

FIGS. 10 and 10A illustrate a detailed bottom and cross-sectional view, respectively, of the cap spacer tube 76 shown in FIG. 9 according to an embodiment of the present invention. The cap spacer tube 76 prevents the cap 44 from being crushed when force is exerted by the tieback system 41. An opening 77 in the bottom of the cap spacer tube 76 accepts the tieback rod 54 as shown in FIG. 10. The opening 77, in conjunction with the shim 82, permits the cap 44 to remain level while accommodating various entry and exit angles of the tieback rod 54. As illustrated in FIGS. 10 and 10A, cap spacer tube 76 is substantially an elongated, hollow square. It should be noted, however, that alternative shapes may be used while remaining within the scope of the present invention.

Figure 11:
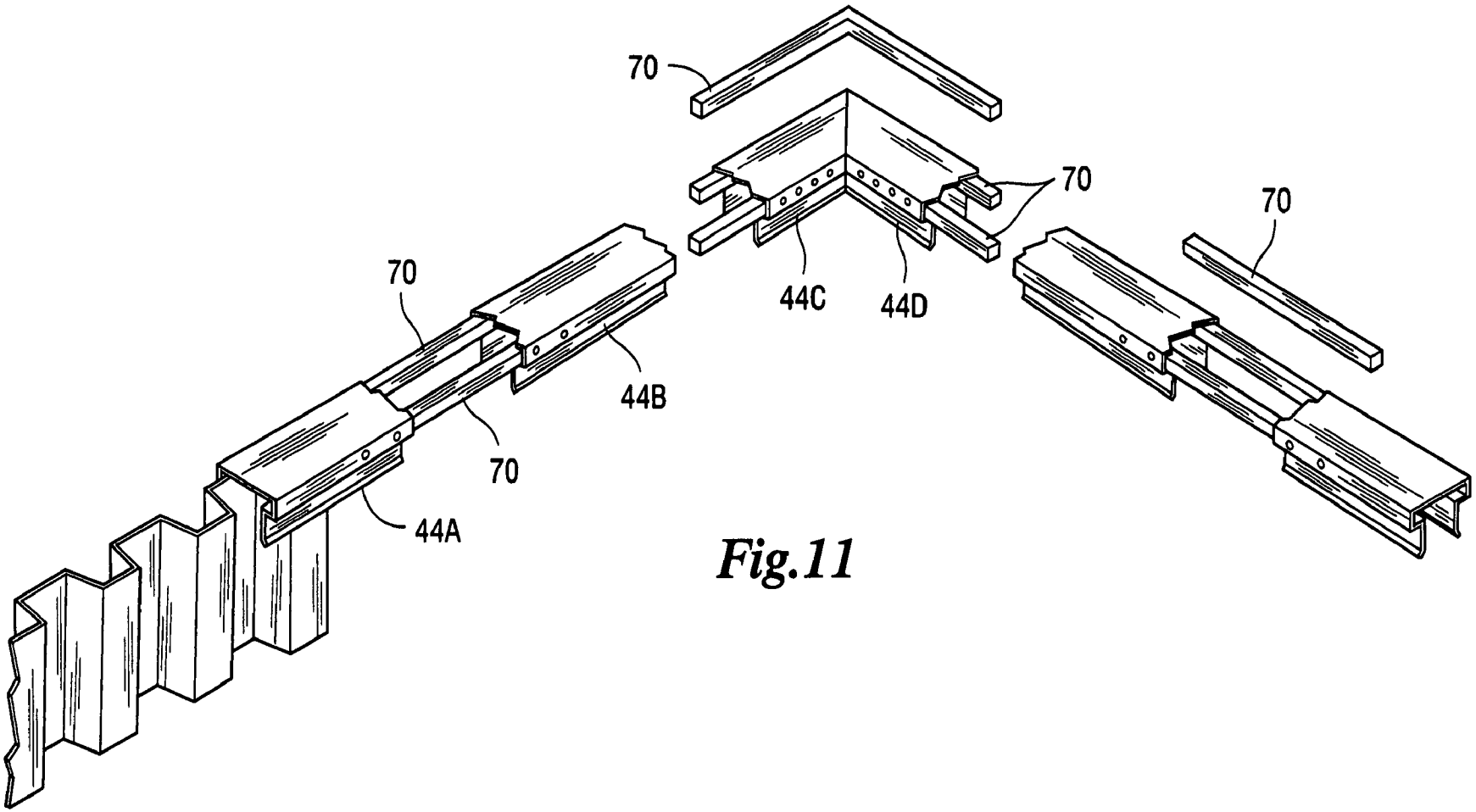
FIG. 11 is a cutaway view of the caps shown in FIG. 9 to illustrate cap splices of the retaining wall system of FIG. 4 according to an embodiment of the present invention.

FIG. 11 is a cut-away view of adjacent caps 44 illustrating cap splices 70 of the retaining wall system 40 of FIG. 4 according to an embodiment of the present invention. The caps (e.g., 44A and 44B, 44C and 44D, etc.) are joined by one or more cap splices 70. In the current embodiment, each cap splice 70 is sized (as best illustrated in FIGS. 9 and 14) to fit within void formed by the top cap wall 86, upper side wall 87, offset wall 88, and sheet piling 60. It should be noted, however, that the void into which the cap splice 44 is placed may be altered while remaining within the scope of the present invention. As one example, the void may be formed by the top cap wall 86, the upper side wall 87, the offset wall 88 and an interior cap wall (not shown), such that the cap splice does not come into contact with the sheet piling 60.

In the current embodiment, approximately one-half of the length of cap splice 70 is inserted into one cap (for example 44A) and the other one-half of cap splice 70 is inserted into the adjacent cap (for example 44B). Each cap section (e.g., 44A, 44B) is then fastened to the cap splice 70, and thus, to each other. In the current embodiment, self-tapping screws are used to connect a cap 44 to a cap splice 70. It should be noted that the placement and number of fasteners used may be dictated by design considerations, and other fastening means may be used while remaining within the scope of the present invention.

Cap splice 70 may also connect adjacent caps 44 that abut each other at an angle. As illustrated in FIG. 11, caps 44C and 44D are connected by a cap splice 70 having a 90° angle. It should be noted that cap splices 70 having specific angles may be manufactured as a single piece, or two or more cap splices 70 may be mitered and joined to form the desired angle or angles. Each cap section (e.g., 44C, 44D) is then fastened to the cap splice 70, and thus, to each other.

In the current embodiment, cap splice 70 is substantially an elongated square, approximately 32 inches in length. It should be noted that other shapes (for example, that used in FIG. 14) and lengths may be used for cap splice 70 while remaining within the scope of the present invention. Furthermore, cap splice 70 may be hollow, semi-solid, or solid, depending on the application.

Figure 12:
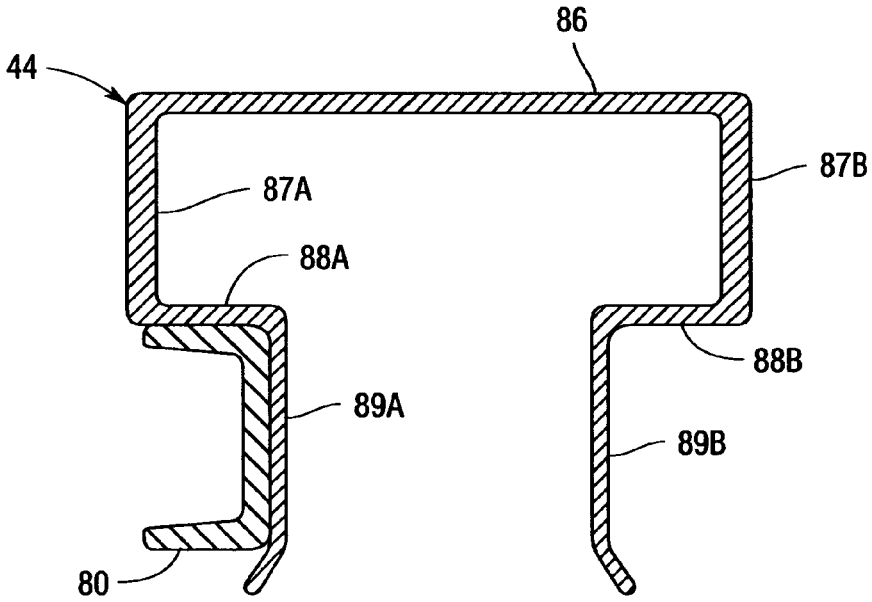
FIG. 12 is a cross-sectional view of a cap channel attached to the cap of FIG. 9 according to an embodiment of the present invention.
Figure 13:
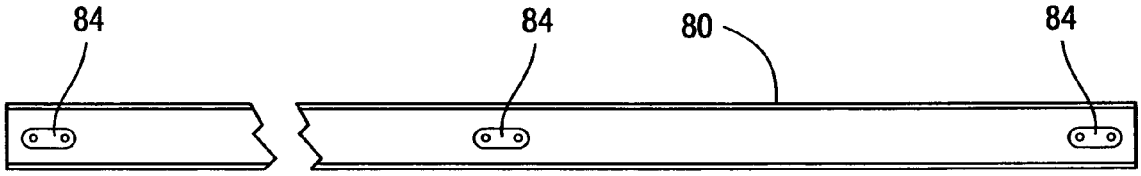
FIG. 13 is a detailed view of the cap channel of FIG. 12 according to an embodiment of the present invention.

FIG. 12 is a cross-sectional view of a cap channel 80 attached to the cap 44 of FIG. 9 according to one embodiment of the present invention. FIG. 13 is a detailed view of the cap channel 80 as shown in FIG. 12. The cap channel 80 may be used to add additional support to the cap 44 and distribute the forces exerted by the tieback system 41, among others. As best illustrated in FIG. 12, cap channel 80 is secured against a lower side wall 89 of the cap 44, under an offset wall 88, which connects the lower side wall 89 to an upper side wall 87. In an alternative embodiment, the offset wall 88A and the lower side wall 89B may be constructed to form a cap channel that is integral to the cap 44, thus eliminating the need for a separate cap channel 80.

Referring now to FIG. 13, the cap channel 80 includes one or more holes 84 for fastening the cap channel 80 to the cap 44. In the current embodiment, an end of a tieback rod 54 passes through a cap channel hole 84 and a tieback fastener 74 is attached to the tieback rod 54. The diameter of the tieback fastener 74 is sized larger than the diameter of the cap channel hole 84 (or alternatively, an appropriately sized washer or shim among others is used) so that the cap channel 80 is secured to the cap 44. In an alternative embodiment, cap channel 80 is secured to the cap 44 using nuts and bolts that are not a part of the tieback system.

FIG. 14 is a cross-sectional view of a cap 44 for the retaining wall system of FIG. 4 according to an embodiment of the present invention. In the embodiment illustrated in FIG. 14, cap 44 does not function as part of the tieback system 41, and thus is secured to the top of sheet piling 69 using means other than the tieback rod 54 and fastener 74. For example, cap 44 may be secured to the sheet piling 60 using self-tapping screws (not shown).

In the current embodiment, all components of the retaining wall system, including the tieback system 41, sheet pilings 60, caps 44, wales 10, wale splices 36, cap channels 80, cap spacer tubes 76, cap splices 70, sheet piling connectors 68, template supports 48, and inside wales 46, among others, are comprised of composite materials (such as, FRP), are of unitary construction, and are formed using a pultrusion process. The retaining wall system of the present invention is lightweight, easy to install, and provides sufficient structural capabilities, resists rotting, insect infestation, corrosion, and detrimental effects. It should be noted, that other opposite materials, non-unitary construction methods, and other manufacturing techniques may be used while remaining within the scope of the present invention.

The above-described embodiments of the invention are intended to be illustrative only. Numerous alternative embodiments may be devised by those skilled in the art without departing from the scope of the following claims.

What is claimed is:

1. A wale and retaining system for use in bracing a retaining wall, the system comprising:

a wale of a unitary construction and comprising pultruded composite material, the wale further comprising, a back wall having a first opening therethrough, a front wall having a channel formed therein and extending from a first end of the wale to a second end of the wale, the front wall having a second opening therethrough, said front wall comprising, a first front outer wall and a second front outer wall each substantially parallel to the base wall, a channel base wall substantially parallel to said base wall, a first channel side wall extending between both said first front outer wall and said channel base wall, a second channel side wall extending between both said second front outer wall and said channel base wall, and a first interior reinforcing wall and a second interior reinforcing wall connecting said back wall and said front wall to form a middle and two side chambers between said back wall and said front wall, and wherein the middle and two side chambers extend from the first end of the wale to the second end of the wale, a tieback rod extending through the first opening, said middle chamber, and the second opening;

a fastener coupled to said tieback rod and disposed within the channel;

and wherein said channel has a depth sufficient such that when said wale is secured to said retaining wall by the tieback rod passing through said wale and the fastener, said tieback rod and said fastener do not protrude from the channel.

2. The system of claim 1 wherein said composite material is fiberglass reinforced plastic resin impregnated composite.

3. A retaining wall wale and retaining system, comprising:

a wale of a unitary construction and comprising pultruded composite material, the wale further comprising, a back wall, a front wall having a top portion and a bottom portion interconnected by a C-shaped channel portion extending from a first end of the wale to a second end of the wale, said top and bottom portions substantially parallel to said back wall, and said C-shaped channel portion including a channel bottom portion. a first channel side portion and a second channel side portion, a top wall connecting said back wall to said top portion, a bottom wall connecting said back wall to said bottom portion to form a chamber between said back wall and said front wall, and an upper reinforcing wall and a lower reinforcing wall each connecting said back wall to said channel bottom portion of said C-shaped channel portion such that at least three chambers are formed between said back wall and said front wall and extending from the first end of the wale to the second end of the wale;

a tieback rod extending through the channel bottom portion, a middle one of the chambers, and the back wall;

a fastener coupled to said tieback rod and disposed within the channel; and and wherein said channel portion has a depth sufficient such that when said wale is secured to a retaining wall by the tieback rod passing through the said wale and the fastener, said tieback rod and said fastener do not protrude from the channel portion.

4. A wale and retaining system for use in bracing a retaining wall, said system comprising:

a wale of a unitary construction, the wale further comprising, a base wall having a first opening therein and operable for receiving a tieback rod therethrough. a front wall, a first side wall and a second side wall, each of the first side wall and the second side wall extending between both the base wall and the front wall, wherein the front wall includes a channel formed therein, and the front wall comprises:

a first front outer wall and a second front outer wall each substantially parallel to the base wall.

a channel base wall substantially parallel to the base wall and having a second opening therein and operable for receiving the tieback rod therethrough, a first channel side wall extending between both the first front outer wall and the channel base wall, and a second channel side wall extending between both the second front outer wall and the channel base wall, and a first interior reinforcing wall and a second interior reinforcing wall, each of the first interior reinforcing wall and the second interior reinforcing wall extending between the base wall and the channel base wall, thereby forming at least a middle chamber and two side chambers, and wherein a distance between the first interior reinforcing wall and the second interior reinforcing wall is less than a distance between the first channel side wall and the second channel side wall;

wherein the tieback rod extends through the first opening, the middle chamber, and the second opening; and a fastener coupled to said tieback rod and disposed within the channel.

5. The wale and retaining system of claim 4 wherein said channel has a depth sufficient such that when said wale is secured to a retaining wall by the tieback rod and the fastener, said tieback rod and said fastener do not protrude from the channel.

6. The wale and retaining system of claim 4 wherein said wale further comprises a pultruded composite material.

7. The wale and retaining system of claim 6 wherein said composite material is fiberglass reinforced plastic resin impregnated composite.

* * * * *

UNITED STATES PATENT AND TRADEMARK OFFICE

CERTIFICATE OF CORRECTION

PATENT NO. : 7,311,470 B2
APPLICATION NO. : 10/619131
DATED : December 25, 2007
INVENTOR(S) : Shane E. Weyant and Dustin L. Troutman It is certified that error appears in the above-identified patent and that said Letters Patent is hereby corrected as shown below:

On the title page item (57) in the Abstract: Line 10, delete “atop” and insert -- a top --.

Column 1, line 20, delete “know” and insert -- known --.

Column 6, line 46, after “be” delete “is”.

Signed and Sealed this

Twenty-seventh Day of May, 2008

JON W. DUDAS
*Director of the United States Patent and Trademark Office*